United States Patent [19]

Bloothoofd

[11] Patent Number: 5,012,738

[45] Date of Patent: May 7, 1991

[54] PRINTING PLATE LOCKING DEVICE

[75] Inventor: William Bloothoofd, Wilmington, Del.

[73] Assignee: Hercules, Incorporated, Wilmington, Del.

[21] Appl. No.: 435,185

[22] Filed: Nov. 13, 1989

[51] Int. Cl.[5] ..... B41F 27/12

[52] U.S. Cl. ..... 101/415.1; 101/378; 369/197; 369/265

[58] Field of Search ..... 101/378, 415.1; 269/197, 265, 266, 267

[56] References Cited

U.S. PATENT DOCUMENTS

| | | | |
|---|---|---|---|
| 1,149,037 | 8/1915 | Duwelius | 269/267 |
| 1,169,533 | 1/1916 | Duwelius | 269/267 |
| 3,659,525 | 5/1972 | Woessner et al. | 101/378 |
| 3,793,918 | 2/1974 | Huffman | 269/267 |
| 3,896,729 | 7/1975 | Moyer | 101/415.1 |
| 4,724,762 | 2/1988 | Jeschke | 101/415.1 |

*Primary Examiner*—Edgar S. Burr
*Assistant Examiner*—John S. Hilten
*Attorney, Agent, or Firm*—Connolly & Hutz

[57] ABSTRACT

A locking device for clamping plates, such as printing plates, in place includes a housing. A jaw is in the housing with a plurality of sets of clamp members mounted in the jaw. Each of the clamp members has rounded clamp surfaces. Spacers separate the sets of clamp members from each other. A fixed stop member is located at one end of the jaw and an actuating member is movably mounted at the other end of the jaw. When the actuating member is manipulated to move further into the jaw the spacers press against the clamp members to displace a clamp member of each set into its clamping or locking position with the plate clamped between the inside jaw and a wall of the housing.

15 Claims, 2 Drawing Sheets

24
46
58
60
36
48
42
16
7
34
32
38
54
44
40
52
6
50
56

PRINTING PLATE LOCKING DEVICE

BACKGROUND OF INVENTION

There is a need in various fields to clamp plate members in place. One such field having such a need is in printing presses and more particularly rotary printing presses. For example, with conventional rotary printing presses the printing plate saddle is formed in two halves, each of which is wrapped around half of the plate cylinder. In order to mount the printing plates substrates in place a pair of locking mechanisms are generally provided on each end of the saddles. Each such locking mechanism pair would clamp the leading end of one substrate and the trailing end of the other substrate to the cylinder. Generally, the mounting of the substrates is achieved by first fixing one end of the substrate and then mounting that substrate half way around the cylinder with the other end being in a slightly slack condition when it is inserted into the clamping mechanism. The tensioning mechanism which is spring loaded would then be actuated to take up the slack and stretch the cylinder blanket and tautly mount the substrate to the cylinder. The clamping mechanism could be double ended to change the direction of rotation.

SUMMARY OF INVENTION

An object of this invention is to provide a locking device, particularly adaptable for use in printing presses such as rotary printing presses wherein the plates may be mounted in a quick and reliable manner.

A further object of this invention is to provide such a locking device wherein the clamping may take place by a simple manual manipulation.

In accordance with this invention, the locking device includes a housing which is preferably a C-shaped jaw with an inside jaw being located in the housing. The inside jaw functions includes sets of clamping members which are spaced from each other by spacers. A fixed stop member in the form of a setscrew is located at one end of the inside jaw and an actuating member is movably mounted at the other end of the jaw. Alternatively, fixed stop members could be at each end of the jaw and the actuating member could be mounted for center actuation. The actuating member would be manipulated so that as it moves further into the track and applies a linear force which presses the spacers and clamping members together so that a clamping member from each set would be displaced and forced into clamping engagement with a plate inserted in a space between the inner surface of the housing and the outer surface of the jaw.

In a preferred form of this invention, the clamping members comprise a set of three balls with cushioning material located under the central ball. The cushioning material functions to spread the balls which are generally aligned when the lock is loosened. The cushioning material acts as a spring to facilitate in displacing the central ball out of the line of travel of the other balls and of the spacer members when the lock is tightened.

The spacer members are preferably pins having rounded or cupped ends to conform to the spherical shape of the clamping balls. The actuating member is preferably a locking screw which may be manipulated by turning its enlarged head. The stop member is preferably a set screw which also functions for pitch adjustment.

THE DRAWINGS

DETAILED DESCRIPTION

Figure 1:
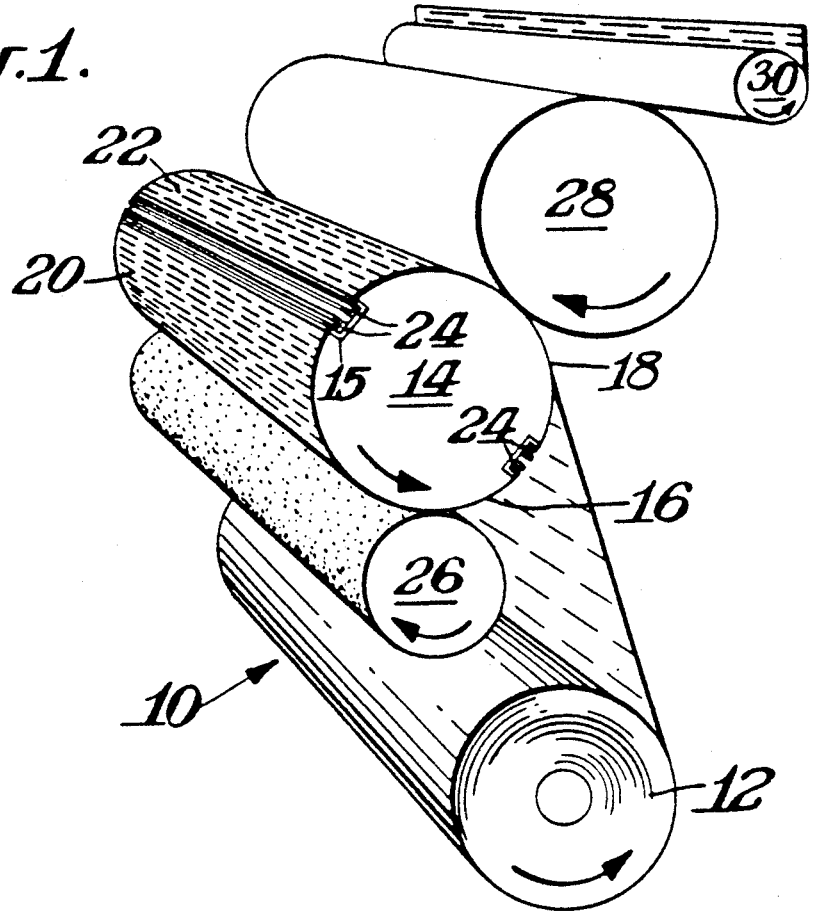
FIG. 1 is a perspective view showing a rotary printing press in accordance with this invention.

FIG. 1 illustrates a rotary printing press 10 in accordance with this invention. As shown therein printing press 10 includes a roll of paper supply 12 which may be used for printing, for example, newspapers. Printing press 10 also includes plate cylinder 14. Plate cylinder 14 may be considered as being in two sections for mounting side by side and end to end printing plates which are used for printing the newspapers. In the embodiment illustrated in FIG. 1 two such printing plates or plate substrates 16, 18 are secured to one section of plate cylinder 14 while a second set of printing plates 20, 22 is secured to the other half or section of plate cylinder 14. The printing plates are secured to cylinder 14 by sets of plate locks or locking devices 24, 24. Printing press 10 also includes an ink cylinder or cylinders 26 and an impression cylinder 28 as well as backing roll 30.

It is to be understood that although FIG. 1 illustrates a rotary printing press such illustration is for exemplary purposes and the invention may be practiced in any environment requiring a flat member such as a sheet or plate to be locked in place. The member could have a curved, round or irregular surface.

FIGS. 3-7 better illustrate the details of locking device 24. As shown therein locking device 24 includes a housing 32 in the form of a C-shaped outer jaw of any suitable length. An inside jaw 34 is mounted in housing or outside jaw 32 by being inserted through the open side of the C-shaped jaw. Inside jaw 34 functions to hold various components and to perform the clamping action. The inside jaw 34 is mounted in its proper location in housing 32 by means of threaded pins 36 which extend through corresponding threaded holes in one wall 58 of housing 32. Jaw 34 would have recesses 38 positioned for receiving pins 36. Recesses 38 are smooth and of sufficient depth to permit relative movement of track 34 toward or away from wall 58 of housing 32.

Figures 3, 4, 5, 6, 7:
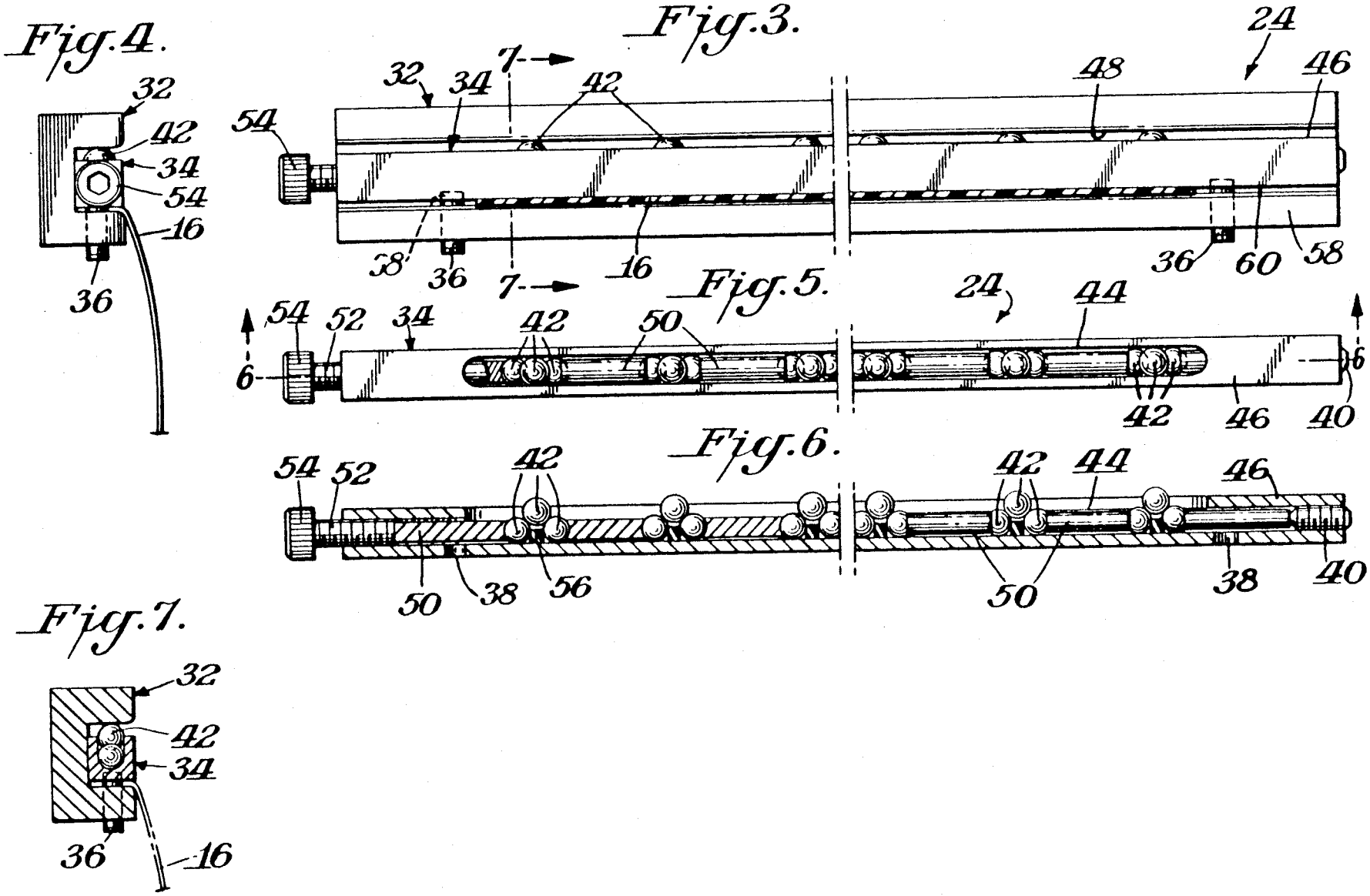
FIG. 3 is a front elevation view of the locking device shown in FIGS. 1-2.
FIG. 4 is an end elevation view of the locking device shown in FIG. 3.
FIG. 5 is a top plan view of the track used in the locking device of FIGS. 3-4.
FIG. 6 is a cross-sectional view taken through FIG. 5 along the line 6—6.
FIG. 7 is a cross-sectional view taken through FIG. 3 along the line 7—7.

As best shown in FIG. 6 one end of jaw 34 includes a stop member 40 which is preferably in the form of a setscrew threaded into one end of jaw 34. Sets of clamping members 42 are also located in jaw 34. As shown in FIGS. 5-6 jaw 34 includes an elongated slot 44 in its wall 46 disposed toward wall 48 of outside jaw 32. Slot 44 is dimensioned to permit a ball from each set of balls 42 to extend through the slot and make contact with wall 48 of jaw or housing 32.

As also illustrated in FIG. 6 the sets of clamping balls 42 are spaced from each other by spacer pins 50. Spacer pins 50 terminate at each end in a curved or cupped configuration to conform to the curvature of the spherical balls 42. The end most spacer pin 50 is positioned in contact with setscrew 40. The opposite end most spacer pin 50 is positioned in contact with actuating member 52. Actuating member 52 may be of any suitable construction but is preferably a locking screw threadably engaged in the threaded opening in jaw 34. Actuating member 52 has an enlarged knurled head 54 to facilitate the actuation thereof. When locking screw or actuating member 52 is manipulated to move inwardly in jaw 34 toward setscrew 40 a force is applied against the sets of clamping balls 42 and spacing members 50 to squeeze the locking balls and pins together between fixed setscrew 40 and moving actuating member 52. As a result of this force the central ball of each set of balls 42 is displaced outwardly into elongated slot 44 and toward contact with wall 48 of outside jaw or housing 32. This displaced movement is facilitated by locating a cushioning spacer 56 beneath the center most clamping ball. Cushioning spacer 56 may be made of any suitable material such as rubber and functions as a spring to assist in urging the center most ball 42 outwardly while maintaining the end most balls equally spaced from each other. As center most balls 42 press against wall 48 the reaction is also to shift the entire inside jaw 34 toward wall 58 of housing 32 and thereby clamp any member such as an end of a printing plate between the outer surface of jaw 34 and the inner surface of wall 58. This surface to surface clamping action actuated by spaced point contacts of balls 42 is extremely effective even with slippery members such as plates 16, 18.

In the illustrated embodiment locking device 24 is used for clamping printing plate substrates in a rotary printing press. The substrates would be mounted in the following manner. Substrate 16 would be inserted in the space 60 between the outer surface of jaw 34 and wall 58. Plate 16 would be of a width so that it is located between registration pins 36. The opposite end of the plate would be clamped 180° around cylinder 14 in a similar manner. Manipulating member 52 would then be rotated by turning knob or head 54 to press the spacers and balls toward each other as previously described. Manipulating member 52 would be rotated until substrate or plate 16 is firmly clamped between wall 58 and jaw 32 as a result of the shifting of jaw 34 which would result in a surface to surface clamping of substrate 16. Because recess 38 is not threaded the jaw 34 can shift with respect to jaw 32 and retaining and registration pins 36. The edges of the jaws of housing 32 are radiused so as to avoid the substrates being bent over a sharp edge.

Figure 2:
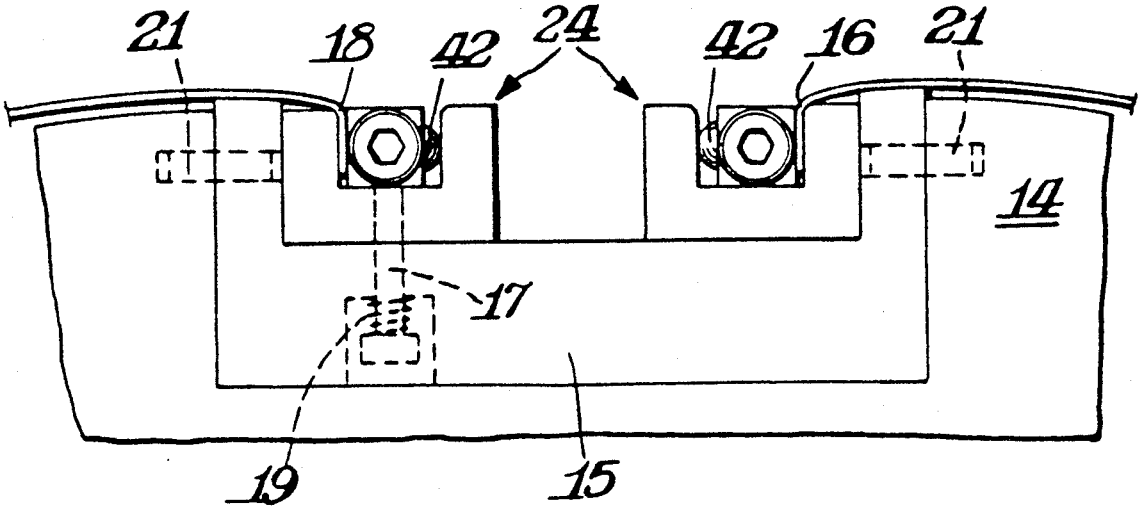
FIG. 2 is an end elevation view of a portion of the printing press shown in FIG. 1.

As shown in FIG. 2 a pair of mirror image locking devices 24, 24 are provided on each half of cylinder 14 for locking the leading end of one plate and the trailing end of the other plate. One locking device would preferably be spring loaded in any manner, while the other locking device could be fixed, although both devices could be spring loaded. Thus, the leading edge of a plate could first be locked in the fixed locking device and the trailing edge of the plate could be secured in the spring loaded locking device half way around cylinder 14. The spring loading permits the trailing end to be tensioned so that the plate is locked in a taut condition. FIG. 2 illustrates plate 16 to be in a fixed locking device and plate 18 to be in a spring loaded locking device.

The spring loading may be done in any suitable manner. FIG. 2 illustrates a mounting block 15 for devices 24, 24. The spring loaded device is mounted on a bolt 17 biased by spring 19. When the device 24 is lowered to tension the printing plate, it is held in this tensioned condition by retaining screw 21.

As previously noted stop setscrew 40 functions not only as an abutment to prevent the end most spacer 50 from moving away from actuating member 52, but also setscrew 40 serves to control pitch adjustment if the pitch of jaw 34 is slightly off. The position of setscrew 40 also determines the gap adjustment to accommodate different thickness plates.

Although clamping members 42 have been described and illustrated as being spherical balls the invention may also be practiced by forming the clamping members as for example pins or links of a chain. In each of these embodiments there would be a plurality of clamping members and the clamping members would have rounded surfaces so as to permit a center clamping member to be displaced into clamping engagement with a plate and thereby provide a positive plate lock.

The locking device of this invention in its preferred form thus consists of a C-shaped housing in which there is a movable jaw actuated by the turning of a capscrew or lever. The device utilizes the mechanical advantage obtained by exerting pressure on low friction clamping sets spaced to displace the jaw by point load concentration at several intervals along the jaw. The self adjusting nature of the clamping sets serves to apply equal pressure to the clamped member over a large surface area preventing loss of clamping pressure due to small irregularities in the member.

What is claimed is:

1. A locking device for clamping a member in place comprising a housing, said housing having an abutment surface and a clamping surface remote from said abutment surface, a jaw in said housing, said jaw having a first wall disposed adjacent said abutment surface of said housing, said jaw having a clamping wall disposed adjacent said clamping surface of said housing whereby a member to be clamped may be inserted between said clamping surface and said clamping wall, an elongated slot in said first wall, a plurality of sets of clamp members in said jaw, each of said sets comprising three clamp members, said three clamp members being two end members separated by an intermediate member, a cushioning member disposed under the intermediate clamp member in each of said sets to urge said intermediate clamp member toward said slot, each of said clamp members having rounded clamp surfaces, spacers separating said sets from each other, said spacers contacting said clamp members, a fixed stop member in said jaw, an actuating member in said jaw remote from said stop member, and said actuating member being movable into said jaw to provide a force against said spacers and said clamp members to displace said intermediate clamp member from each set partially through said slot and against said abutment surface of said housing as said spacers and clamp members are squeezed between said actuating member and said stop member whereby said jaw is moved toward said clamping surface of said housing to clamp the member between said clamping surface and said clamping wall.

2. The device of claim 1 wherein said jaw is an inside jaw, said housing comprising a C-shaped outside jaw, and said abutment and clamping surfaces being opposite walls of said outside jaw.

3. The device of claim 2 wherein each of said spacers comprises a pin having a cupped end wall in surface contact with a respective clamping member.

4. The device of claim 3 wherein each of said sets of clamp members comprises three balls.

5. The device of claim 4 wherein said stop member is at one end of said inside jaw, and said actuating member being at the opposite end of said inside jaw.

6. The device of claim 5 including holes extending through one wall of said housing, recesses in said inside jaw aligned with said holes, and jaw retaining and registration pins extending through said holes and into said recesses.

7. The device of claim 6 wherein said holes and registration pins are threadably engaged with said inside jaw, and said recesses have smooth inner walls.

8. The device of claim 7 wherein said actuating member comprises a locking screw engaged in said inside jaw.

9. The device of claim 8 wherein said stop member a pitch adjusting setscrew engaged in said inside jaw.

10. The device of claim 9, in combination with a rotary printing press having a printing cylinder with a printing plate substrate mounted thereon, and said device locking one end of said substrate to said cylinder.

11. The combination of claim 10 wherein a pair of substrates are mounted end to end around said printing cylinder, and an end of the other of said substrates being clamped between said housing and said inside jaw remote from said one end of said substrate.

12. The combination of claim 11 wherein sets of said devices are mounted at diametrically opposite portions of said cylinder, each of said sets comprising a pair of said devices, and at least on device of each pair being spring loaded to tension its said substrate.

13. The device of claim 1, in combination with a rotary printing press having a printing cylinder with a printing plate substrate mounted thereon, and said device locking one end of said substrate to said cylinder.

14. The combination of claim 13 wherein a pair of substrates are mounted end to end around said printing cylinder, and an end of the other of said substrates being clamped between said housing and said inside jaw remote from said one end of said substrate.

15. The combination of claim 14 wherein sets of said devices are mounted at diametrically opposite portions of said cylinder, each of said sets comprising a pair of said devices, and at least on device of each pair being spring loaded to tension its said substrate.

* * * * *